US005218148A

United States Patent [19]

Mochak

[11] Patent Number: 5,218,148

[45] Date of Patent: Jun. 8, 1993

[54] SQUARE EXTRACTOR FOR THE REMOVAL OF CARTRIDGE CASES FROM THE CHAMBERS OF A REVOLVER

[75] Inventor: Richard J. Mochak, Woronoco, Mass.

[73] Assignee: Smith & Wesson Corp., Springfield, Mass.

[21] Appl. No.: 888,730

[22] Filed: May 20, 1992

[51] Int. Cl.[5] ..... F41A 15/02

[52] U.S. Cl. ..... 42/68

[58] Field of Search ..... 42/68, 62, 63, 89

[56] References Cited

U.S. PATENT DOCUMENTS 517,152 3/1894 Wesson ..... 42/68
1,202,342 10/1916 Wesson ..... 42/89
4,720,930 1/1988 Schreiber ..... 42/62

FOREIGN PATENT DOCUMENTS 2901445 11/1979 Fed. Rep. of Germany ..... 42/89

*Primary Examiner*—Stephen M. Johnson
*Attorney, Agent, or Firm*—Chapin, Neal & Dempsey

[57] ABSTRACT

An extractor for the removal of cartridge cases from the chambers of a revolver is mounted adjacent the outer end of a tubular stem. The extractor is in the form of a plate having a plurality of radially extending arms equally spaced apart and defining, between each adjacent pair of the arms, a cylindrical surface which conforms with the inner cylindrical surface portion of one cartridge chamber of the revolver cylinder. The outer edge portion of each of the arms is generally a rectilinear edge and together define a rectangular shape having its geometric center aligned with the longitudinal axis of the stem. The revolver cylinder includes a recess in the rear surface of the cylinder which has a depth approximately equal to the thickness of the extractor plate and includes inner, rectilinear edge portions contiguous to and parallel with each of the outer edge portions of the extractor arms to limit rotation of the extractor plate relative to the axis of the cylinder.

4 Claims, 1 Drawing Sheet

SQUARE EXTRACTOR FOR THE REMOVAL OF CARTRIDGE CASES FROM THE CHAMBERS OF A REVOLVER

BACKGROUND OF THE INVENTION

This invention relates to extractors used for removal of the empty shells or "brass" from the chambers of a revolver cylinder and, in particular, to an extractor of improved construction which substantially simplifies the manufacture and assembly of the extractor and cylinder.

Extractors of the conventional type data back to at least 1916 and were disclosed in U.S. Pat. No. 1,181,417 to J. H. Wesson and assigned to SMITH & WESSON COMPANY. Since that time, such extractors have remained essentially unchanged from that disclosed in the '417 Patent. The extractor is disposed within a shallow recess in the rear face of the cylinder and the outer edges of the extractor arms, disclosed in that patent, may be characterized as radiused or convexly curved surfaces with their center curvature at the longitudinal axis of the cylinder so as to conform generally with concave curved edges of the recess. To limit the angular movement of the extractor plate within that recess, two small extractor pins extend outwardly from the inner recess surface of the cylinder. The pins are diametrically-spaced apart on opposite sides of the cylinder axis and are adapted to fit into holes, correspondingly located and sized, provided through the arms of the extractor plate.

U.S. Pat. No. 4,934,082 issued to Haar. et al in 1990, discloses a cartridge clip 32 carried on an extractor star. The outer edges of the extractor and the clip both have radiused outer edge portions and do not provide means by which the extractor will be maintained in fixed angular position within the recess 26 of the cylinder.

The principal object of this invention is to provide an improved extractor for revolvers which obviates the necessity for providing guide pins and alignment holes in the extractor plate.

Another object of this invention is to provide an extractor of the above type which is not only operationally effective but also enables a more economical manufacturing process than heretofore considered feasible in the production costs of the revolvers which embody such extractors.

The above and other objects and advantages of this invention will be more readily appreciated from a reading of the application in conjunction with the drawings annexed hereto as follows:

Figure 1:
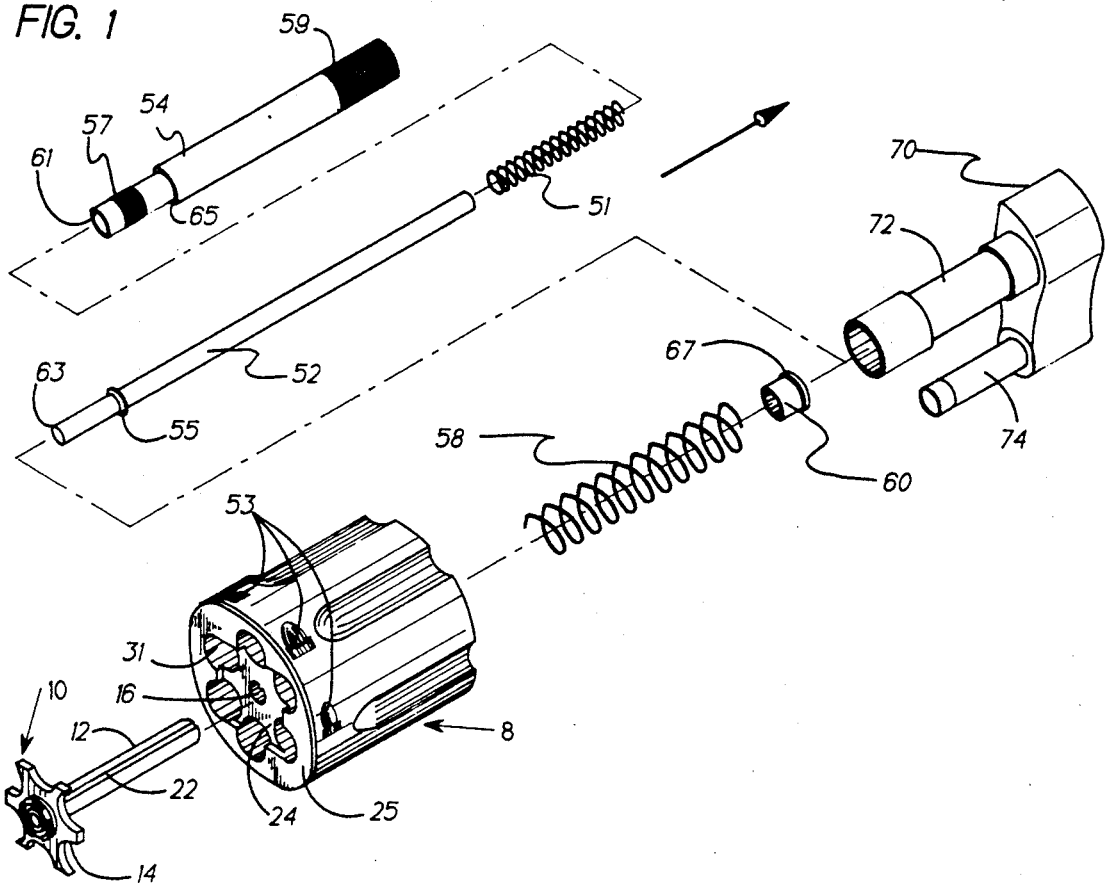
FIG. 1 is an exploded, perspective view of an extractor and associate components used in the cylinder of a revolver of the type embodying this invention.
Figure 2:
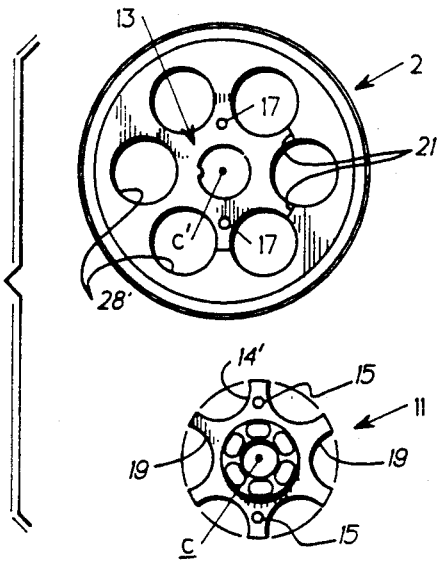
FIG.2 Prior Art
FIG. 2 is an elevational view of a prior art cylinder and extractor of conventional type commonly used in revolvers.

Referring now in detail to the drawings, a cylinder 8 having its forward end toward the right, as indicated by an arrow in FIG. 1, for use in a revolver is adapted to be fitted with an extractor plate 10 of the type embodying this invention, while in FIG. 2, is shown a conventional extractor 11 adapted to fit within recess 13 of cylinder 2. The extractor plate 10 (FIGS. 1 and 4) is disposed adjacent the rear end of a tubular stem 12 and includes a plurality of radially-extending arms 14. The stem 12 is slidably disposed within a bore 16 (FIG. 3) that extends axially through the cylinder 8. The bore includes a projection or lug 20 adapted to interfit with a longitudinally extending groove 22 in the stem 12 to limit movement of the stem in the cylinder 18 to the longitudinal or axial direction. The after-end of the cylinder 8 includes a shallow recess 24 adapted to receive therein the extractor plate 10 such that the upper surface of the extractor plate, including its arms 14, will be generally flush with the peripheral rear surface 25 of cylinder 8 about the recess 24. Because it is not feasible to hold close enough tolerances between the lug 20 and the elongated slot 22, additional means have conventionally been provided to align such extractor plates with the chambers of the cylinder.

In the prior art, as shown in FIG. 2, the extractor plate 11 is similarly disposed on a longitudinally slotted stem of the type described above and shown at 12 in FIG. 1. A pair of holes 15 extend through oppositely extending arms 14' that are adapted to receive therein upstanding pins or studs 17 of cylindrical configuration and which extend outwardly of the lower surface of recess 13 to fit within holes 15 as the extractor plate 11 is fitted into recess 13. This arrangement is provided to ensure precise circumferential alignment of the cylindrically curved surfaces 19 of the arms 14' with the bores of cylinder 2 so that the curved edge surfaces 19 will fit under the corresponding rim portions of cartridges (not shown). It will be noted that the outer ends of each of the arms 14' is convexly curved or radiused about the geometric center c of the extractor plate 11 and the recess 13 is defined in part by edges 21 which are similarly radiused about the longitudinal axis c' of the cylinder 2, but with sufficient clearance for ease of assembly.

Figure 3:
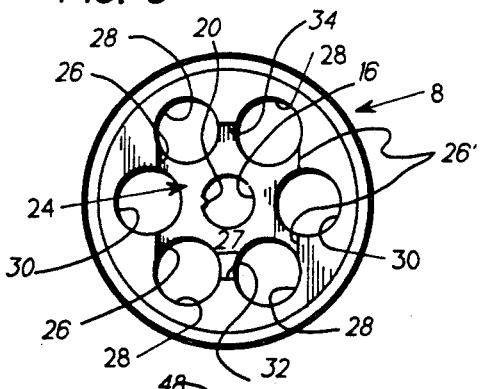
FIG. 3 is an elevational view, similar to FIG. 2, of a revolver cylinder and extractor of the type embodying this invention.

As shown in FIG. 3, the recess 24 is defined by its lower surface 27 machined into or otherwise formed in the rear surface 25 of the cylinder 8 and the upright edge portions of the recess 24, including two rectilinear edge portions 26 which are parallel to each other and to two similar edge portions 26' disposed in spaced, opposed relation on the opposite side of the recess 24. Located intermediate the straight edges 26 and edges 26' are semi-cylindrical edges 30 which are provided by the portions of the chambers 31 that extend beyond the bottom surface 27 of the recess 24. From the outer edges of the edges 26 and 26', the recess includes semi-cylindrical edges 28 which, in the same manner as edge 30, also conform with chambers 31 through the cylinder 8. Additional straight edges 32 and 34 disposed between each of the curved edges 28 and, together with edges 26 and 26' of the recess 24, define a rectangle or square, as best indicated at 49 (FIG. 4) defined by the outer edges of extractor arms 14.

The extractor plate 10 includes a plurality of arms 14 that extend radially from the inner or hub portion of the plate secured to the stem 12. Each arm 14 includes a radially extending longitudinal axis a and is defined by radiused side edges 40 and rectilinear or straight outer edges 44 and 48 adapted to fit respectively in edge-to-edge, contiguous parallel relationship with the upright edges 26 and 26' and with the two edges 32 and 34 which define, in part, the perimeter of the recess 24.

The axis a for each arm extends in a radial direction from the inner or hub portion of the plate 10. Edges 48 are disposed at a perpendicular angle $\gamma$ to the longitudinal axis a of their respective arms and edges 44 are disposed at an oblique acute angle $\alpha$ or oblique obtuse angle $\beta$ to the longitudinal axis a of their respective arms. The recess 24 is thereby adapted to receive therein the extractor plate or star 10 and without the use of extractor pins, as at 17 (FIG. 2), will, because of their rectilinear shape, minimize rotational or angular movement of the extractor plate 10 relative to the chambers 31 in the cylinder 8. The edges 40 are adapted to fit under the rims of cartridge cases disposed in the chambers 31 of the cylinder 8.

Figure 4:
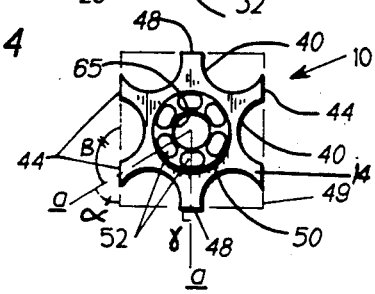
FIG. 4 is an elevational view of the extractor of FIG. 1.

As shown in FIG. 4, the extractor 10 also includes, on its rear surface, an upstanding ring or annulus 50 on which are formed a plurality of ratchet projections or lugs 52. Each such ratchet 52 is disposed in radial alignment with one of the arms 14 of the extractor. A mechanical "hand" (not shown) is located to engage on the ratchets 52 sequentially to rotate the cylinder incrementally as the trigger of the revolver is moved to fire each round carried in the several chambers of the cylinder 8. With each increment of rotation of cylinder 8, one of the recesses or cutouts 53 in the outer peripheral surface of the cylinder 8 adjacent its rear surface 25, will be released by a locking member (not shown) disposed to alternately engage and release each of the recesses 53 to enable indexing movement of the cylinder 8 in response to movement of the trigger as has been more fully shown and described in U.S. Pat. No. 4,641,449.

Disposed within the stem 12 of the extractor is a center pin 52 about which the cylinder 8 is rotatable. A center pin spring 51 is fitted about the forward end portion of the pin 52 and the inner or rear end of the spring 51 is seated against a flange 55 on the pin 52. The rear end of the pin 52 and the spring 51 are fitted into the bore of the stem 12 and an extractor spring 58 and a collar 60 adapted to fit within the forward end of spring 58 are fitted about the outer diameter of the stem 12 and disposed within the bore 16 of the cylinder 8. The flange 55 on pin 50 is engaged with a shoulder within the stem 12 adjacent its rear end. The forward end portion of the center pin 52 and spring 51 are received into the open end of the extractor rod 54 and the rear end 61 of the extractor rod 54 serves as a seat for the forward end of the spring 51. The rear end portion of the rod 54 is threaded, as at 57, for screw-fitting into the internally threaded forward end portion of the stem 12 to complete the assembly. Further, the rod 54 being of stepped outer diameter includes a shoulder 68 which serves as a seat for a rim or flange 67 of the collar 60 disposed within the forward end of the extractor spring 58. The other end of the spring 58 is seated against the forward surface of the extractor plate 10.

Spring 51 releasably urges the pin 52 rearwardly, or to the left, as depicted in FIG. 1. The rear end of the pin, as at 63, extends outwardly of the center hole 65 (FIG. 4) of the extractor plate 10 and serves as a locking mechanism in a detent for holding the cylinder 8 in the window of the frame and in alignment with the barrel of the revolver and is releasable by a thumb piece assembly, as is well known in the art and is shown and described in U.S. Pat. No. 4,934,081. The forward end of the extractor rod, knurled as at 59, to facilitate grasping and manipulating the rod 54 to operate the extractor, extends through a tubular arbor portion 72 of yoke 70. The yoke 70 includes a stud portion 74 adapted to fit for pivotable movement into a cylindrical bore of a revolver frame (not shown) for pivotable movement of the cylinder 8 into and out of the window of the revolver frame, as shown and described in U.S. Pat. Nos. 1,181,417 and 4,934,081. The forward end of the extractor rod 54 is adapted to be releasably engaged by a spring loaded plunger within a bolt housing (not shown) disposed on a lower portion of the barrel, as shown and described in U.S. Pat. No. 4,934,081. After the cylinder 8 is swung out of the frame window, the shooter may grasp the knurled end of the rod 54 and move the rod and stem 12 connected thereto. The extractor plate 10 will thereby eject the cartridge cases from the chambers of the cylinder 8. As the rod 54 is moved rearward in this manner, extractor spring 58 will be compressed and when released, the spring 58 will return the extractor rod 54 and the extractor 10 to its forward position in recess 24. At the same time, the radial arms 14 of the extractor plate 10 will automatically be repositioned in angular alignment with the cartridge receiving chambers 31 of the cylinder 8 because of the rectilinear configuration of the arms 14 and the corresponding upright edge portions of the recess 24. Significantly, moreover, this advantageous result is achieved without the necessity of using extractor pins and holes to receive the pins as in the prior art extractors.

The foregoing description is intended to describe the preferred form of the invention and the best mode contemplated by me for carrying out this invention. To those skilled in the art, however, various modifications and variations to the specific embodiments described herein may be apparent without departing from the scope of my invention.

Having thus described my invention, what is claimed is:

1. Extractor for removal of spent cartridge cases from chambers of a revolver cylinder comprising an extractor plate disposed adjacent an outer end of a tubular stem adapted to be fitted into a central bore through the cylinder, said plate including a plurality of arms, each of said arms having a radially extending longitudinal axis and a substantially straight outer edge portion, the outer edge portion of each of at least two of said arms being disposed at an oblique angle to the longitudinal axis of that arm, said arms having radiused side edges, said cylinder having an outer end surface, a recess formed in said end surface and adapted to receive therein said extractor plate, said recess including outer edge portions corresponding in shape to each said straight outer edge portion and adapted to be contiguous to and in parallel relationship with each said outer edge portion of said arms so that the radiused side edges of the radially extending arms will be retained in alignment with the chambers of said cylinder when said extractor plate is disposed in said recess.

2. Extractor for removal of spent cartridge cases from the chamber of a revolver cylinder, as set forth in claim 1, in which said outer edge portions of the arms generally define a rectangle.

3. Extractor for removal of spent cartridge cases from the chamber of a revolver cylinder, as set forth in claim 2, in which said cylinder has a central axis, and said outer edge portions of the arms define a square having its geometric center at the central axis of said cylinder.

4. Extractor for removal of spent cartridge cases from the chamber of a revolver cylinder, as set forth in claim 3, in which said stem includes a longitudinal slot and the bore includes a projection engageable with the slot to limit movement of the stem within the bore to longitudinal motion.

* * * * *